United States Patent [19]

Angevine et al.

[11] 4,448,672

[45] May 15, 1984

[54] PROCESS FOR THE COMBINED DEASHING/DEASPHALTING OF COAL LIQUIDS

[75] Inventors: Philip J. Angevine, West Deptford; Michael B. Carroll, Mantua; Stuart S. Shih, Cherry Hill; Samuel A. Tabak, Wenonah, all of N.J.

[73] Assignee: Mobil Oil Corporation, New York, N.Y.

[21] Appl. No.: 385,159

[22] Filed: Jun. 4, 1982

[51] Int. Cl.[3] ..... C10G 21/14

[52] U.S. Cl. ..... 208/86; 208/309; 208/313; 208/211

[58] Field of Search ..... 208/309, 313, 320, 177, 208/86

[56] References Cited

U.S. PATENT DOCUMENTS

| | | | |
|---|---|---|---|
| 2,901,413 | 8/1959 | Newchurch et al. | 208/86 |
| 2,950,244 | 8/1960 | Lawson, Jr. | 208/309 |
| 3,291,718 | 12/1966 | Biribaver et al. | 208/86 |
| 3,423,308 | 1/1969 | Murphy | 208/309 |
| 3,627,675 | 12/1971 | Ditman et al. | 208/309 |
| 3,811,843 | 5/1974 | Morfit et al. | 208/309 X |
| 3,972,807 | 8/1976 | Vitti et al. | 208/309 |
| 3,975,396 | 8/1976 | Bushnell et al. | 208/309 |
| 3,998,726 | 12/1976 | Bunas et al. | 208/309 |
| 4,088,540 | 5/1978 | Bunas | 208/309 X |
| 4,177,134 | 12/1979 | Rhodes | 208/177 |
| 4,225,420 | 9/1980 | Rhodes | 208/177 |
| 4,278,529 | 7/1981 | Gearhart | 208/309 |
| 4,305,812 | 12/1981 | Shih et al. | 208/309 |

*Primary Examiner*—Delbert E. Gantz
*Assistant Examiner*—Glenn A. Caldarola
*Attorney, Agent, or Firm*—Alexander J. McKillop; Michael G. Gilman; Richard D. Stone

[57] ABSTRACT

A process for the purification of liquefied coal is disclosed, employing a polarity gradient for fractionation. Maltenic and asphaltenic fractions are isolated. Integration of the fractionation process with additional processes such as distillation, partial oxidation, and catalytic hydrotreating is also disclosed.

12 Claims, 3 Drawing Figures

INTEGRATION OF COMBINED DEASHING/DEASPHALTING WITH SRC-OR H-COAL-LIKE PROCESS

PROCESS FOR THE COMBINED DEASHING/DEASPHALTING OF COAL LIQUIDS

BACKGROUND OF THE INVENTION

1. Field of the Invention

This invention is directed to a process for the purification of coal-derived liquids, specifically, a process by which coal liquids may be fractionated to isolate a low Conradson Carbon Residue (CCR) maltenic fraction, a high CCR asphaltenic fraction and at the same time remove solid impurities. This invention is further directed to the use of a distillation separatory process to establish a concentration gradient between a high polarity and a low polarity solvent within an extraction column, and the integration of this distillation process with additional processes to provide economic and efficient production of liquefied coal fuel sources.

2. Description of the Prior Art

As petroleum resources become increasingly scarce and expensive, an important step in making coal liquefaction processes more commercially attractive will stem from improvements in solid/liquid separation, an essential step prior to the coal-liquid's use as a fuel. Unlike petroleum residua, liquefied coal contains significant quantities of solid material from various sources: (a) ash and mineral matter from the original coal, (b) attrited and/or entrained catalyst from the liquefaction step, and (c) unconverted coal. The mineral matter in particular is highly dependent upon the coal source employed and is variable with any given coal seam.

In some coal liquefaction designs some of the solid is moved by a bank of hydroclones. In other processes the solid is eliminated by filtration; some configurations employ a deasphalting step. Many of these single step deashing operations produce a single reject stream including both solids and low quality asphaltic bottoms. Other multi-step schemes utilize filtration or solvent dilution, followed by settling. By employing a system comprising a distillation-induced polarity gradient extraction of the liquefied coal, the inventors have discovered a new process which achieves both solids recovery and liquid product fractionation in a single operation.

SUMMARY OF THE INVENTION

The process disclosed and claimed herein is based on a concept which produces a solvent concentration gradient for enhanced multi-solvent extraction of liquefied coal comprising the use of a multi-solvent polarity gradient dependent distillation system. By careful selection of appropriate solvents, a sharp polarity gradient can be established, which allows the recovery in increased yields of the desirable maltenic fraction low in CCR. The other liquid fraction produced in an asphaltenic fraction which can be used as a source of hydrogen or alternately a source of coke. Further, solids may be removed from the bottom of the column, and recovered for other valuable uses.

In addition to the distillation column and process itself, a method has been devised for integrating this solid/liquid separation with coal liquefaction processes and with downstream processing which should result in additional savings, not only from the higher recovered yields, but also from lower cost of operation.

DETAILED DESCRIPTION OF THE INVENTION

Figure 1:
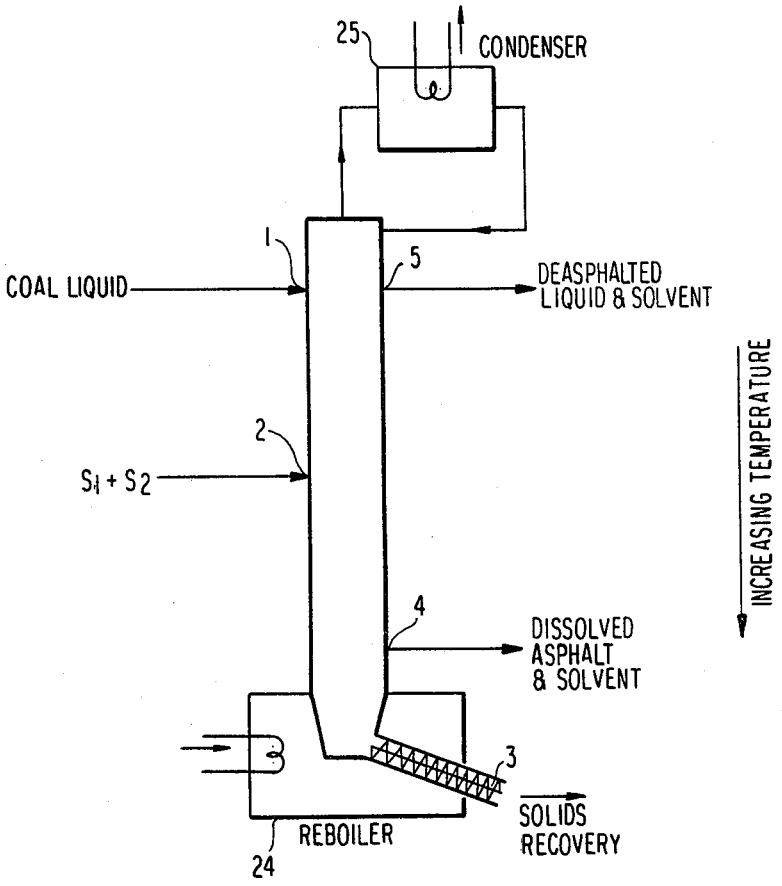
FIG. 1 shows a schematic diagram of the polarity gradient extraction process of this invention by which deasphalting and deashing may be combined.

FIG. 1 shows a schematic diagram of the polarity gradient extraction process of the claimed invention. A solids-laden coal liquid feed (i.e., containing ash, catalyst fines and unreacted coal) is injected into the upper part of the column 1 as shown. Solvents $S_1$ and $S_2$ are injected into the column at a point or points 2 located below the feed injection port. The polarity gradient extraction column is in some ways similar to a distillation column, operating in a liquid-continuous manner. Packing or other internals may be used to achieve a desired vapor/liquid distribution; there can be both upflow and downflow of the liquid phase. The solvent mix is chosen such that the boiling points of the selected solvents are excluded from the boiling range of the coal liquid, and so that they can be distilled into high and low polarity fractions. Therefore, the action of the reboiler 24 and condenser 25 will be to establish a temperature gradient and, consequently, a solvent concentration gradient and polarity gradient through the column. The theory and operation of the polarity gradient distillation column employed in this invention is fully disclosed in application Ser. No. 259,113, filed Apr. 30, 1981, which application is incorporated by reference herein.

In the upper portion of the column, the coal liquid, near its injection point, fractionates into a maltenic fraction (low CCR, $S_1$ soluble) which is drawn off at 5, and the solids-rich asphaltenic (i.e., high CCR, $S_1$-insoluble) fraction which is drawn off at 4. The terms "maltenic" and "asphaltenic" are used here for operational purposes and do not necessarily represent materials similar in quality to those fractions of petroleum residua. In general, the coal liquids will be significantly more polar and oxygenated than petroleum residua; and the solvents $S_1$ and $S_2$ may also be more polar than those used in deasphalting residua. Following separation the maltenic phase is then carried up the column by mass flow while the asphaltenic phase precipitates down the column due to the density difference between the asphaltenes and the solvent.

The higher polarity solvent, $S_2$, is selected such that it dissolves essentially all of the reacted coal, and boils at a higher temperature than the other solvent(s) with a typical $S_2$ solvent being toluene or pyridine. This invention contemplates, but is by no means limited to, solvent systems such as: Examples of two solvent systems include: (a) any of propane, butane, pentane or hexane with toluene; (b) propane, butane or pentane with pyridine; (c) propane or butane with cyclopentane; (d) propane, butane and pentane with cyclohexane; (e) hexane with dimethyl ketone.

Another example of a solvent system is a mixture of butane and pentane as one solvent with any of toluene, pyridine or dimethyl ketone.

Solids recovery is carried out at the bottom of the column 3, exiting the column through a screw feeder. The solvent $S_2$ and the dissolved asphaltenic fraction are removed from the extraction column at a point 4 just above the reboiler. This exit stream may contain a small fraction of $S_1$, due to a lack of complete $S_1/S_2$ separation. Similarly, the $S_1$-rich stream containing the maltenic fraction may have a small portion of $S_2$.

As suggested above, the solvent polarity gradient in the disclosed extractor is established by the composition gradient of the solvents and/or temperature gradient in the extractor. This solvent polarity gradient provides the ability to practice continuous extraction and the flexibility to control the quality and quantity of extract from the top of the extractor.

The required solvent-to-hydrocarbon feed ratio is dependent upon the feedstock properties and will, in general, increase with increasing feed heterogeneity. The operating range of this ratio is about 0.1 to 100 (volume of solvent/volume of feed), generally, and about 1 to 20, preferably.

Similarly, the required residence time is dependent upon the feedstock properties. Required residence times can be reduced by the use of mechanical contacting devices. Space velocities (LHSV) defined as volume of oil/hr/volume of extraction column range from about 0.1 to 10 $hr^{-1}$, generally, and about 0.2 to 5, preferably.

For optimum separation of the solvents from the feedstocks, the solvents should boil at least 100° F. below the initial boiling point of the feedstock to permit easy separation thereof, as by a vapor-liquid flash separation. Further the boiling points of one solvent should differ by at least 50° F. from the other solvent or solvents so separation can be obtained in, for example, a vapor-liquid flash vessel. Still further, in one embodiment of the invention, the column temperature and pressure are controlled such that at least one of the solvents exists as a supercritical fluid.

Operating pressures range from about 0 to 2000 psig, generally and about 0 to 500 psig, preferably. Pressures should be high enough for all solvents which have critical temperatures above the operating temperature to be primarily in the liquid phase.

Figure 2:
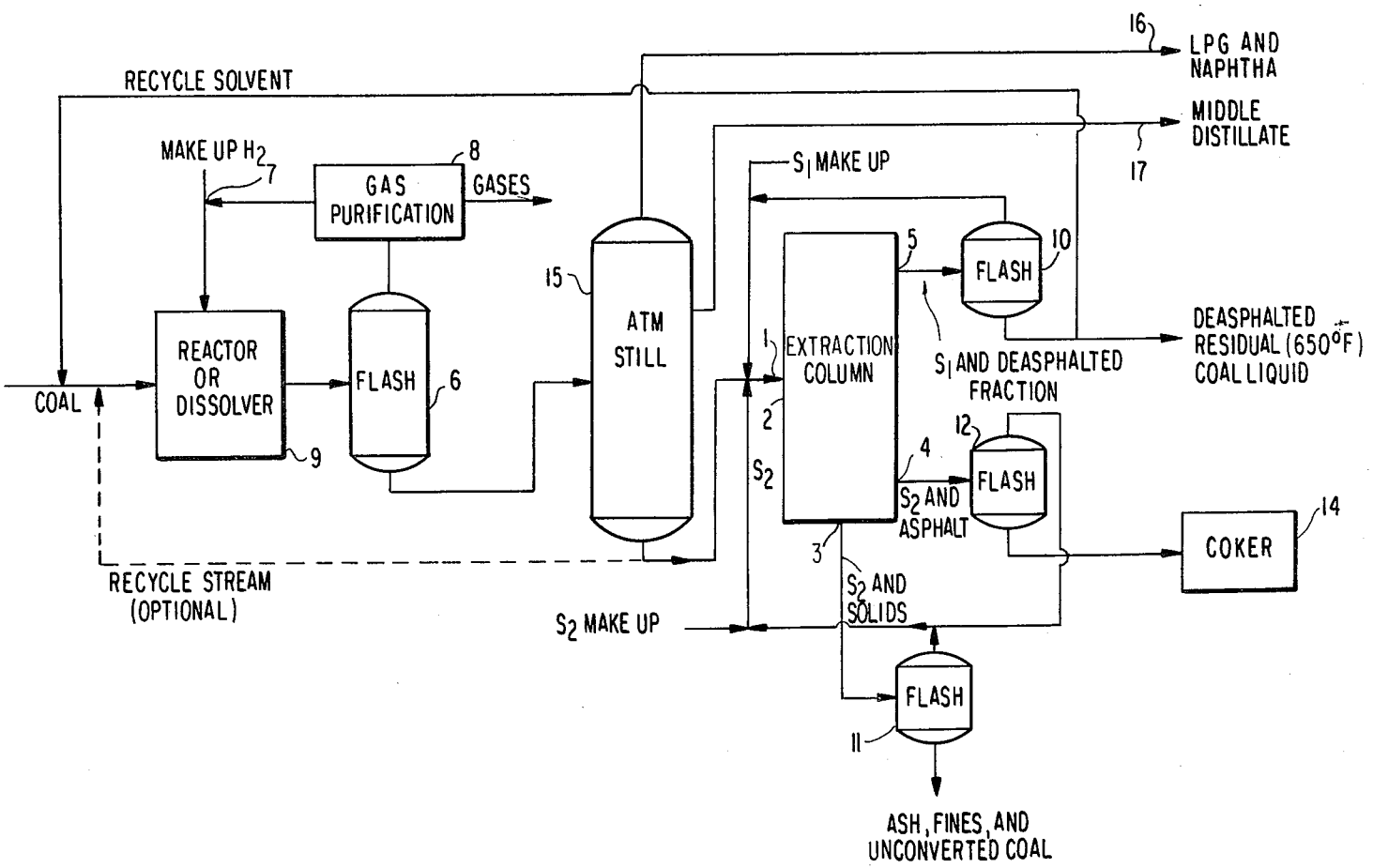
FIG. 2 is a schematic diagram of the integration of polarity gradient extraction with coal liquefaction.

An example of the integration of the polarity gradient extraction process of this invention with a coal liquefaction process is schematically diagrammed in FIG. 2. In this example, the entire liquid product is sent first to an atmospheric distillation unit 15 and then to the extraction column 2. High quality LPG and Naptha 16, as well as a middle distillate 17, are drawn off before the extraction column. In this case, the coal is liquefied and hydrotreated in a single reactor or dissolver 9 to improve its fuel properties prior to extraction in a single unit. The liquefied coal is separated from gas and solvent in a flash distillation operation 6. Some gas may be recycled 7 after purification 8. The net product from the process is removed in the overhead (i.e., $S_1$-rich) stream 5. The $S_1$ solvent is recovered from the stream by flash distillation 10. The solids and $S_2$-asphalt-rich streams 3, 4 are removed from the bottom of the column. Following a flash distillation 11 to remove any remnant solvent, the coal-rich solids stream can be burned as refinery fuel, sent to a gasifier as a source of hydrogen or low BTU gas, or used as landfill. A preferred embodiment includes the introduction of fresh coal to the solids stream followed by partial oxidation to provide hydrogen. The asphalt stream 4, also following a flash distillation 12 to recover light solvents, can be fed to a coker 14. The coke produced will be low in ash, sulfur and contaminant metals content. This metallurgical-grade coke should command a premium price. As is apparent, by employing the extraction process of this invention, three immediately valuable fractions are isolated from one previously unusable liquefied coal stream.

Figure 3:
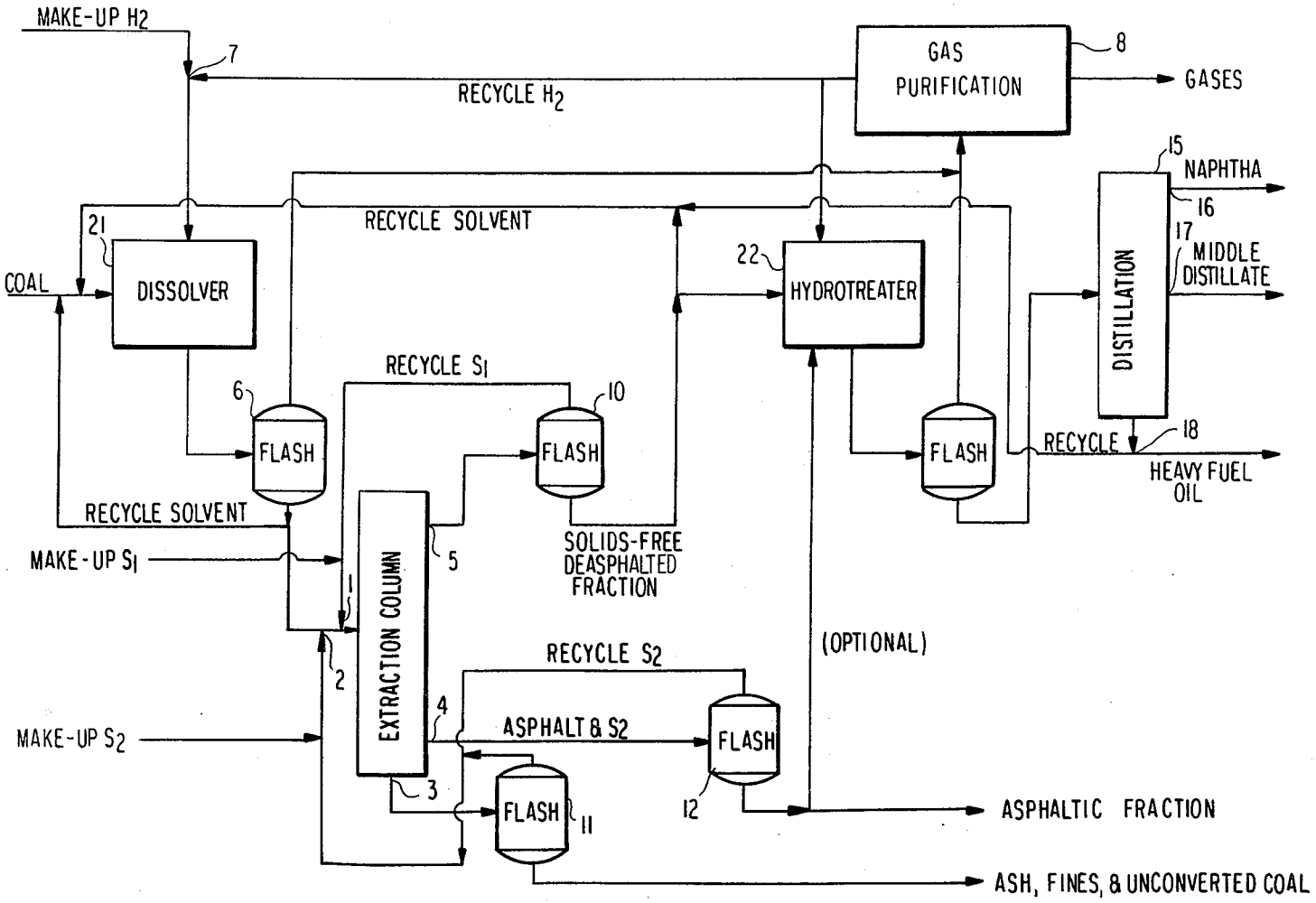
FIG. 3 is a schematic diagram of the integration of polarity gradient extraction with coal liquefaction processes wherein the steps of coal dissolution and catalytic hydrotreating are separated.

Another example of an integrated operation is shown in FIG. 3. In this configuration the coal dissolution step 21 and catalytic hydrotreating step 22 are decoupled, enabling the two processes to be carried out under different operating conditions. The placement of the polarity gradient extraction deashing/deasphalting process of this invention eliminates the solids from the system as well as eliminating some or all of the asphaltic bottoms. Elimination of solids is desirable prior to catalytic upgrading because the ash can deposit on the catalyst, causing rapid and irreversible poisoning. A second cause of catalyst poisoning is the lay down of coke, caused in part by asphaltic coke-precursive molecules. Qualitatively, these coke precursors are hydrogen-deficient and are high in CCR. Due to the deasphalting feature of the process of this invention, the hydrotreating catalyst is protected against the high CCR material. This advantage can ultimately be translated into reduced operating costs or improved product quality.

It will thus be seen that the polarity gradient extraction process of this invention is not only a significant advance in the art of liquefied coal processing, but, when integrated downstream from a coal liquefaction process, results in surprising and substantial economic savings.

As indicated, the precise processes described above are merely representative of the range of processes and embodiments which could be used in practicing this invention. It is to be understood therefore that specifically mentioned apparatus and materials are illustrative only, and that any changes made, especially as to matters of shape, size and arrangement, to the full extent of the general meaning of the terms in which the appended claims are expressed, are within the principle of the invention.

We claim:

1. A process for the combined deashing and deasphalting of liquified coal comprising (a) charging to a vertically oriented deashing/deasphalting column, having a top, an upper portion, a lower portion, a bottom and a feed point a feed comprising a liquified coal containing solids into the upper part of said column;

(b) subjecting said feed within said column to contact with at least a first and a second solvent; and wherein (i) said second solvent is more polar than said first solvent and (ii) said second solvent has a boiling point higher than said first solvent within said colunn;

(c) heating said lower portion of said column whereby said lower portion is hotter than said upper portion and wherein the temperature in said lower portion is sufficient to vaporize at least a majority of said first solvent while maintaining at least a majority of said second solvent in liquid phase, whereby said lower portion of said column is relatively deficient in said first solvent and said upper portion of said column is relatively enriched in said first solvent;

(d) removing from the bottom of said column a liquid stream containing a majority of said solids in said feed;

(e) removing from said lower portion at a locus above the bottom of said column, a liquid phase containing a majority of said asphalt and said second solvent;

(f) removing from an upper portion of said column, at a locus below the top of said column, a liquid stream containing a majority of said deasphalted liquid and said first solvent, (g) withdrawing from the top of said column a vapor stream comprising said first solvent.

2. Process of claim 1 wherein said first solvent and said second solvent are comingled and added to said column at a location intermediate said feed point and said bottom.

3. Process of claim 1 wherein the total solvent/feed volume ratio is about 0.1:1 to 100:1.

4. Process of claim 1 wherein the total solvent/feed volume ratio is 1:1 to 20:1.

5. Process of claim 1 wherein said first and second solvents boil at least 100° F. below the initial boiling point of the feed to said column and wherein the boiling point of said second solvent is at least 50° F. higher than said first solvent.

6. The process of claim 1 wherein said liquid asphalt fraction is subjected to conventional coking treatment.

7. The process of claim 1 wherein said upper deasphalted oil is subjected to conventional hydrotreating whereby desulphurization is achieved.

8. The process of claim 1, wherein said first solvent is selected from the group consisting of propane, butane, pentane and hexane and said second solvent is toluene.

9. The process of claim 1, wherein said first solvent is selected from the group consisting of propane, butane and pentane and said second solvent is pyridine.

10. The process of claim 1, wherein said first solvent is selected from the group consisting of propane and butane and said second solvent is cyclopentane.

11. The process of claim 1, wherein said first solvent is selected from the group consisting of propane, butane and hexane and said second solvent is cyclohexane.

12. The process of claim 1, wherein said first solvent is hexane and said second solvent is dimethyl ketone.

* * * * *